United States Patent [19]

Li

[11] Patent Number: 4,527,342

[45] Date of Patent: Jul. 9, 1985

[54] PROCESS FOR COOLING PARTICULATE SOLIDS

[75] Inventor: Ying H. Li, Tucson, Ariz.

[73] Assignee: Atlantic Richfield Company, Los Angeles, Calif.

[21] Appl. No.: 596,213

[22] Filed: Apr. 2, 1984

[51] Int. Cl.[3] ..... F26B 3/08

[52] U.S. Cl. ..... 34/10; 34/13; 34/26; 34/57 A; 34/66

[58] Field of Search ..... 34/10, 13, 20, 26, 30, 34/57 A, 62, 66, 67; 44/1 G

[56] References Cited

U.S. PATENT DOCUMENTS

| | | | |
|---|---|---|---|
| 2,529,366 | 11/1950 | Bauer | 432/15 |
| 3,112,186 | 11/1963 | Davis et al. | 34/10 |
| 3,360,867 | 1/1968 | Sanderson | 432/15 |
| 3,672,069 | 6/1972 | Reh et al. | 34/20 |
| 4,000,563 | 1/1977 | Cubitt et al. | 34/10 |
| 4,185,396 | 1/1980 | Haisser | 34/13 |
| 4,249,909 | 2/1981 | Comolli | 34/15 |
| 4,354,825 | 10/1982 | Fisher et al. . | |
| 4,396,394 | 8/1983 | Li et al. | 34/13 |
| 4,457,081 | 7/1984 | von Wedel | 34/20 |
| 4,495,710 | 1/1985 | Ottoson | 34/10 |

*Primary Examiner*—Larry I. Schwartz
*Assistant Examiner*—David W. Westphal
*Attorney, Agent, or Firm*—F. Lindsey Scott

[57] ABSTRACT

An improved method for cooling particulate solids in a fluidized bed wherein the improvement comprises fluidizing the particulate solids above a first portion of a gas flow distributor using a cooling gas and fluidizing the particulate solids above a second portion of the gas flow distributor with a cooled cooling gas stream wherein the second portion of the gas flow distributor is located near the particulate solids discharge from the fluidized bed.

7 Claims, 2 Drawing Figures

PROCESS FOR COOLING PARTICULATE SOLIDS

This invention relates to an improved process for cooling particulate solids in a fluidized bed.

In recent years, there has been increased interest in the development and use of alternate energy sources to replace petroleum products. One such energy source which has received considerable attention in recent years has been the mining and use of lower rank coals such as brown coal, lignite, and subbituminous coal. Such lower rank coals are desirable for use as a fuel because of their relatively low mining costs and since many such coals have a relatively low sulphur and ash content. The use of such lower rank coals as a fuel has been inhibited by the the fact that such lower rank coals as mined frequently have a high water content. Since such coal is frequently mined at remote locations, the transportation of the water to the site at which the fuel is to be used represents a significant cost. Further, the higher water content of the lower rank coals results in a lower heat value per unit weight for such coal than with comparable coal which has been dried. For these and a variety of other reasons, there has been considerable interest in the development of processes for drying such lower rank coal to produce a dried coal fuel product. Unfortunately, such dried low rank coals frequently exhibit a tendency to spontaneously ignite upon storage, transportation and the like. As a result, many of the processes for drying such low rank coal have included a cooling step. Two processes of this type are shown in U.S. Pat. No. 4,354,825 issued Oct. 19, 1982 to Fisher, et al. and U.S. Pat. No. 4,396,394 issued Aug. 2, 1983 to Li, et al. Both these patents are hereby incorporated in their entirety by reference. Both these processes involve the use of fluidized bed drying vessels and fluidized bed cooling vessels.

Since the value of the dried low rank coal fuel is relatively low, it is necessary that such processes operate at a minimum expense. Accordingly, it is necessary that such processes operate efficiently. In equipment for cooling such dried low rank coal, it has been found desirable to use ambient air as a cooling gas. In many instances, the use of the ambient air is completely satisfactory during a major portion of the year. Unfortunately, it is desirable that such processes be operated on a year round basis and it is necessary that some means be found for cooling the dried particulate low rank coal during those portions of the year when the ambient air temperature is too high to cool the dried coal products to a desired temperature.

According to the present invention, such particulate low rank coal solids are readily cooled during periods of elevated ambient air temperature in a process for cooling such particulate coal solids to a selected temperature in a fluidized bed wherein the fluidized bed is maintained above a support means in a cooling vessel by flowing cooling gas upwardly through the fluidized bed at a rate sufficient to maintain the fluidized bed in a fluidized state and cool the particulate coal solids by an improvement comprising flowing the cooling gas through the particulate solids above a first portion of a support means and flowing a cooled cooling gas through the solids above a second portion of the support means with the second portion of the support means being adjacent the particulate solids discharge from the fluidized bed thereby increasing the capacity of the fluidized bed.

In the discussion of the FIGURES, the same numbers are used to refer to the same or similar components throughout.

Figures 1, 2:
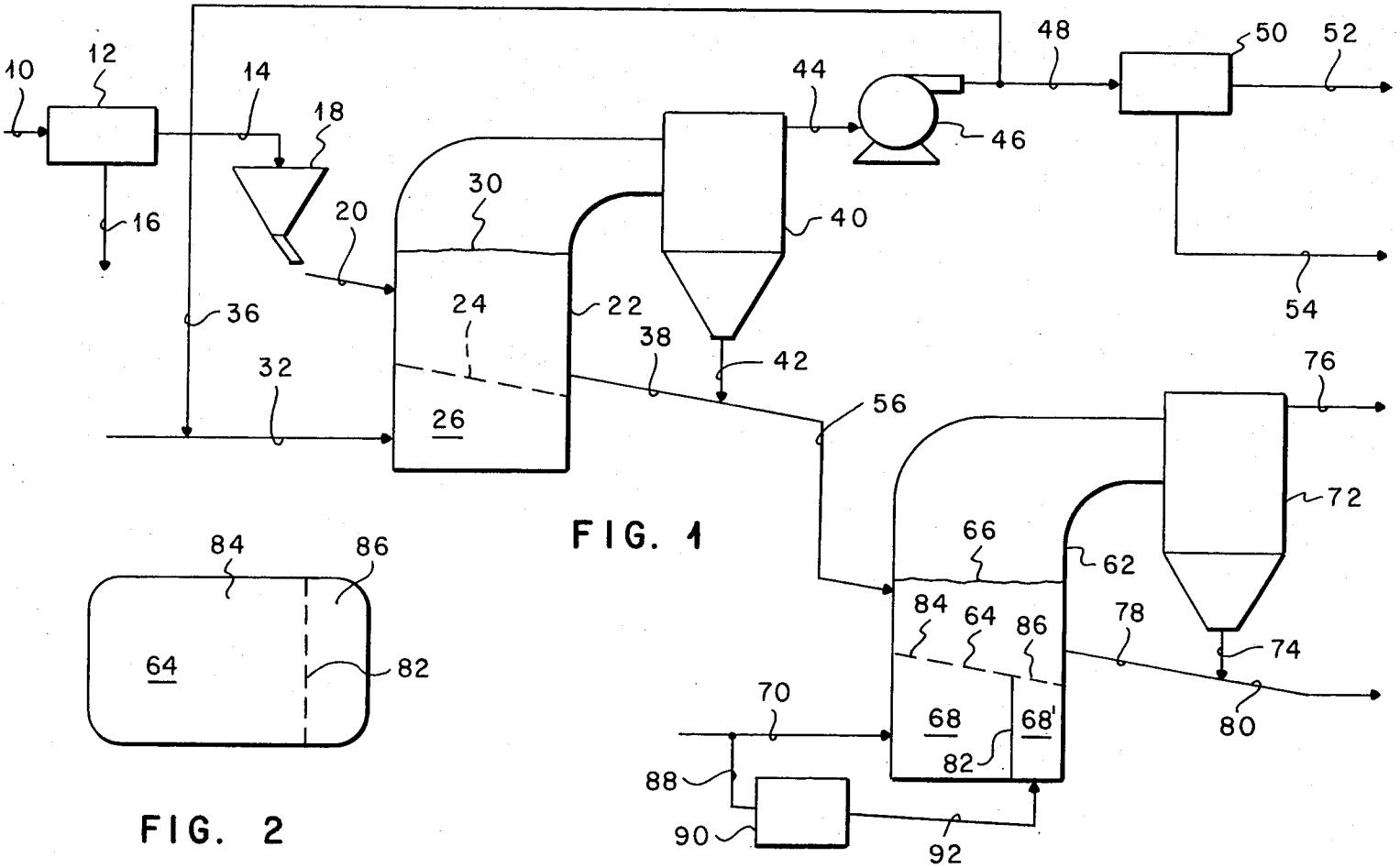
FIG. 1 is a schematic diagram of a process for drying low rank coal to produce a dried low rank coal product which includes an embodiment of the improvement of the present invention.
FIG. 2 is a top view of a support means or a grate demonstrating the improvement of the present invention.

In the discussion of the invention, reference will be made to "lines" to refer to conveyors, conduits and the like as commonly used to transport solid, liquid or gaseous materials as the case may be. The term "fluidized beds" as used herein includes fluidized beds, ebullated beds, semi-fluidized beds and the like. Such beds are known to those skilled in the art to comprise beds of particulate solids which have an apparent volume in excess of their settled volume because of the passage of air or other gases upwardly through the bed.

In FIG. 1, a coal drying process is shown. Coal is charged to a coal treatment zone 12 via a line 10. In coal treatment zone 12, the coal may be crushed to a desired size and inorganic materials, such as clays and gangues, may be separated from the coal and discarded through a line 16. It should be understood that in many instances coal treatment to remove inorganic materials is not required or used with low rank coals. The coal is passed from coal treatment zone 12 through a line 14 to a hopper 18 to provide a coal feed through a line 20 to a coal dryer 22. The coal charged to dryer 22 through line 14 may be of any size up to a size consist of about 2 inches by 0 although preferably the coal is of a size consist of about 1 inch by 0 and more desirably, ¾ inch by 0. Coal is charged from hopper 18 to dryer 22 via line 20 and a bed 30 of coal is maintained in dryer 22 above a support means shown as distributor 24. Distributor 24 may comprise a bar grate, a perforated plate, bubble caps, valve trays or other means known to the art for use in maintaining coal bed 30 in a fluidized condition above distributor 24. A hot fluidizing gas is charged to a distribution zone 26 beneath distributor 24 in dryer 22. The hot fluidizing gas flows upwardly through distributor 24 at a rate suitable to fluidize the coal in bed 30. A portion of the smaller coal particles are typically entrained out of bed 30 and recovered in a gas-solids separator such as cyclone 40. The hot fluidized gas may be produced by burning a suitable fuel, such as carbonaceous liquids, coal fines or the like to produce a combustion gas at a desired temperature. The composition of the fluidizing gas stream can be adjusted by various techniques such as the use of recycle or diluent streams, steam injection or the like. For instance, the composition of the fluidizing gas can be adjusted by the use of a recycle stream taken from the exhaust from dryer 22. Other streams could be used alone or in combination with such a recycle stream to adjust the composition of the fluidizing gas streams. Many such variations may be used to adjust the fluidizing gas composition to a desired range. Such a recycle stream is supplied in FIG. 1 via a line 36 from the exhaust from dryer 22.

The exhaust gas from dryer 22 flows to cyclone 40 where finely divided particulate solids are recovered through a line 42 for further processing, recombination with the dried coal recovered from dryer 22 through a line 38 or the like. The gaseous discharge from cyclone 40 is passed through a line 44, an exhaust fan 46 and a line 48 to a fine solids recovery section 50 where finely divided particulate solids in the nature of dust and the like are separated and recovered through a line 54. The finely divided solids may be passed to use as a fuel, further processing to produce larger particles of coal or the like. The cleaned gases are exhausted through a line 52 and may be passed to further clean-up and the like as required for discharge to the environment.

The dried coal streams recovered through line 38 and line 42 are passed through a line 56 to a cooler 62. In cooler 62, the coal is supported above a support member shown as a distributor 64 in a bed 66 with cooling gas being supplied through a line 70 via a distribution chamber to fluidize and cool the coal in bed 66. Distributor 64 may comprise a bar grate, perforated plate, bubble caps, valve trays or other means known to the art for evenly distributing gas flow upwardly through distributor 64 and bed 66. Cooled coal from bed 66 is recovered through a line 78. The exhaust gases from cooler 62 are passed to a gas-solids separator such as a cyclone 72 from which a gaseous stream is recovered through a line 76 and passed to discharge, to further clean up prior to discharge or the like. An underflow stream is recovered from cyclone 72 through a line 74 and comprises finely divided particles which have been entrained in the exhaust stream from cooler 62. As shown in FIG. 1, the finely divided particles recovered through line 74 are blended with the particles recovered through line 78 to produce a product stream recovered through a line 80.

It will be understood that the finely divided solids recovered through lines 42, 74 and 54 can be treated in a variety of ways or used as fuel. For instance, the finely divided solids could be briquetted, pelletized or otherwise made into larger particles by a variety of means known to those skilled in the art and optionally combined with the larger coal particles. In such instances, the processed finely divided solids may not require cooling in cooler 62.

In the practice of processes such as that shown in FIG. 1, the hot gases used to fluidize and dry the coal in bed 30 are typically at temperatures from about 400° to about 1000° F. (about 204° to about 538° C.). As is well known to those skilled in the art, when low rank coal particles are dried to low water contents, i.e. ten percent or less, they are readily ignited and tend to undergo spontaneous combustion at such elevated temperatures.

Cooler 62 is normally sized to cool the dried coal to a temperature of about 80° F. (about 27° C.). In some instances, the cooling may be to a lower temperature but more commonly, the temperature may be as high as about 100° F. (about 38° C.). Cooling has been found to reduce the tendency of the dried coal to spontaneously ignite. Additional techniques such as oil treatment and the like have been used to further reduce the tendency to spontaneously ignite but are not considered to constitute a part of the present invention which relates to an improved cooling technique. Normally, cooler 62 is sized to use ambient air to cool the dried coal to the desired temperature. In many areas where low rank coal deposits are found, the ambient air temperature is suitable during most seasons of the year to provide a suitable temperature differential in cooler 62 to cool the dried coal products. During the warmer parts of the year, the ambient air temperature may rise to levels such that the ambient air is too warm to function effectively as a cooling gas to produce a cooled dried coal product at the desired temperature. In such instances, the cooling can still be accomplished in existing equipment by the improvement of the present invention. In FIG. 1, a partition 82 is shown dividing the gas distribution zone beneath distributor 64 in cooler 62 into two portions. A second gas distribution zone 68' is separated from a first gas distribution zone 68 by partition 82. A first portion 84 of distributor 64 is positioned above first distribution zone 68 with a second portion 86 of distributor 64 being positioned above second gas distribution zone 68'. When the temperature of the ambient air is elevated, the ambient air is still effective to reduce the temperature of the dried coal product to a lower temperature but not to the temperature desired in the dried coal products. For instance, the dried coal may be charged to cooler 62 at temperatures in the vicinity of 200° F. (about 94° C.). Even if the ambient air is at a temperature of 100° F. (about 38° C.), it is still useful as a cooling gas to reduce the temperature of the dried coal to a temperature approximating that of the ambient air. By the use of the improvement of the present invention, partition 82 is placed beneath distributor 64 and a portion of the ambient air to be used as a cooling gas is passed through a line 88 to a cooler 90 which may be an evaporative cooler, a refrigerative cooler or the like, where the air is cooled to produce a cooled cooling gas which is then passed through a line 92 to second distribution zone 68' and then upwardly through second portion 86 of distributor 64 to further cool the dried coal above second portion 86. In other words, a portion of the ambient air used for cooling in cooler 62 is cooled below the ambient air temperature during the portion of the year when such is necessary and used to complete the cooling of the dried coal particles in a portion of the fluidized bed adjacent the discharge from the fluidized bed. In such instances, the cooling air is cooled to a temperature which is desirably at least 10° F. (about 6° C.) below the ambient air temperature. Second portion 86 of distributor 64 is adjacent the particulate solids discharge from cooler 62. The gaseous overhead stream from cooler 62 may still be at a temperature in excess of the desired discharge temperature for the dried coal product. If such is the case, then the dried coal product recovered through line 78 must be cooled to a temperature sufficiently below the desired discharge temperature to produce a mixed stream of the desired temperature when the particulate solids in line 78 are combined with the particulate solids from line 74.

Desirably, second portion 86 of distributor 64 comprises at least ten percent of the width of distributor 64 as measured from the inlet to cooler 62 to the outlet of cooler 62 as shown in FIG. 2. Normally, second portion 86 will be a relatively small portion of distributor 64. The size of second portion 86 can obviously vary but as the size is increased, increasing amounts of cooled cooling gas will be required since it is desirable that the fluid velocity through bed 66 be substantially the same above all of distributor 64. Since it is desirable to restrict the amount of cooled cooling gas used to the minimum required to meet the cooled dried coal temperature requirement, it is desirable that the size of second portion 86 be kept at a minimum consistent with the process cooling objectives. Desirably, second portion 86 comprises at least one-tenth of the length across distributor 64. Cooling of various types such as evaporative or refrigerative cooling or the like can be used to produce the cooled cooling gas in line 92. Such equipment can be maintained in a stand-by condition with little expense with the operation of the equipment being required only when the ambient temperature exceeds a temperature suitable for cooling in cooler 62.

Having thus described the present invention by reference to certain of its preferred embodiments, it is respectively pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

Having thus described the invention, I claim:

1. In a process for cooling particulate solids to a selected temperature in a fluidized bed, said fluidized bed being maintained above a support means in a cooling vessel by flowing cooling gas upwardly through said fluidized bed at a rate sufficient to maintain said fluidized bed in a fluidized state and cool said particulate solids, the improvement comprising:

(a) positioning a partition beneath said support means to form a first cooling gas distribution chamber beneath a first portion of said support means and a second gas distribution chamber beneath said second portion of said support means when the temperature of the cooling gas is near said selected temperature;

(b) flowing said cooling gas through said particulate solids above said first portion of said support means; and (c) flowing a cooled cooling gas at a temperature at least 10° F. cooler than said cooling gas through said solids above a second portion of said support means, said second portion of said support means being adjacent the particulate solids discharge thereby increasing the cooling capacity of said fluidized bed.

2. The improvement of claim 1 wherein said partition is removable.

3. The improvement of claim 1 wherein ambient air is used as the cooling gas.

4. The improvement of claim 1 wherein said cooled cooling gas is cooled ambient air.

5. The improvement of claim 4 wherein said cooled ambient air is produced by evaporatively cooling ambient air.

6. The improvement of claim 4 wherein said cooled ambient air is produced by refrigeratively cooling ambient air.

7. The improvement of claim 1 wherein said second portion of said support means is at least ten percent of the length of said support means.

* * * * *